US009764747B2

(12) United States Patent
Egler et al.

(10) Patent No.: US 9,764,747 B2
(45) Date of Patent: Sep. 19, 2017

(54) STOPPING TIME CALCULATION MODULE

(75) Inventors: Lars Egler, Braunschweig (DE); Michael Gottschalk, Liebenburg/Ot Kl.Mahner (DE); Bernd Hinze, Berlin (DE); Andreas Steingröver, Braunschweig (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 52 days.

(21) Appl. No.: 14/342,425

(22) PCT Filed: Aug. 23, 2012

(86) PCT No.: PCT/EP2012/066391

§ 371 (c)(1),
(2), (4) Date: Mar. 21, 2014

(87) PCT Pub. No.: WO2013/030074

PCT Pub. Date: Mar. 7, 2013

(65) Prior Publication Data

US 2014/0229041 A1 Aug. 14, 2014

(30) Foreign Application Priority Data

Sep. 1, 2011 (DE) ..... 10 2011 081 993

(51) Int. Cl.
*B61L 15/00* (2006.01)
*B61L 3/00* (2006.01)
(Continued)

(52) U.S. Cl.
CPC ..... *B61L 15/00* (2013.01); *B61L 3/006* (2013.01); *B61L 21/10* (2013.01); *B61L 27/0011* (2013.01)

(58) Field of Classification Search
CPC ..... B61L 15/00
(Continued)

(56) References Cited

U.S. PATENT DOCUMENTS 5,757,291 A * 5/1998 Kull ..... 340/988
6,141,607 A * 10/2000 Hergert-Muckusch et al. ..... 701/19
(Continued)

FOREIGN PATENT DOCUMENTS

CH 535155 3/1973
CN 1496903 A 5/2004
(Continued)

OTHER PUBLICATIONS

NPL english translation of DE 19509696 A1 from EPO.*

*Primary Examiner* — Yazan Soofi
(74) *Attorney, Agent, or Firm* — Laurence Greenberg; Werner Stemer; Ralph Locher

(57) ABSTRACT

A stopping-time calculation module for a vehicle contains a communication device, which enables communication with one or more other vehicles in order to transmit the vehicle's own travel-related data and/or to receive travel-related data of another vehicle or vehicles. An evaluation device is connected to the communication device and is suitable for calculating an extended stopping time that exceeds the stopping time specified by the schedule in the event of a delay for the current stop or a following stop, in particular the next stop, indicated by the travel-related data of a vehicle driving ahead or behind on a common route equipped with stops, and for producing a control signal that indicates the calculated stopping time.

11 Claims, 6 Drawing Sheets

(51) Int. Cl.
*B61L 21/10* (2006.01)
*B61L 27/00* (2006.01)

(58) Field of Classification Search
USPC ..... 701/1, 19, 49
See application file for complete search history.

(56) References Cited

U.S. PATENT DOCUMENTS

| | | | | |
|---|---|---|---|---|
| 6,600,978 | B2 | 7/2003 | Nagasu et al. | |
| 6,980,894 | B1 | 12/2005 | Gordon et al. | |
| 7,096,114 | B2 * | 8/2006 | Feray | 701/117 |
| 7,182,298 | B2 | 2/2007 | Fischer | |
| 8,805,605 | B2 * | 8/2014 | Cooper | B61L 27/0027 104/76 |
| 2015/0142225 | A1 * | 5/2015 | Tonguz | B61L 19/06 701/19 |

FOREIGN PATENT DOCUMENTS

| | | | |
|---|---|---|---|
| CN | 101025766 | A | 8/2007 |
| CN | 101941449 | A | 1/2011 |
| CN | 102143876 | A | 8/2011 |
| DE | 19509696 | A1 * | 9/1996 |
| DE | 69814276 | T2 | 2/2004 |
| DE | 69813052 | T2 | 3/2004 |
| EP | 0341826 | A2 | 11/1989 |
| EP | 1466803 | A1 | 10/2004 |
| GB | 1321054 | A | 6/1973 |
| GB | 2218556 | A | 11/1989 |
| GB | 2324638 | A | 10/1998 |
| JP | 2002325313 | A | 11/2002 |
| WO | 9709217 | A2 | 3/1997 |
| WO | 2004039650 | A1 | 5/2004 |
| WO | 2010026051 | A1 | 3/2010 |

* cited by examiner

STOPPING TIME CALCULATION MODULE

BACKGROUND OF THE INVENTION

Field of the Invention

In the area of rail-based local transit traffic, in subway or local rapid transit traffic for example, passengers are carried from station to station on lines predetermined in accordance with a timetable. The flow of passengers into the stations is an at least approximately steady process and the trains run accordingly, spaced as identically as possible from one another. If—for whatever reason—a train is delayed and this results in a delayed arrival of the train at a station, then more passengers will be waiting for the train at this station—as well as in all subsequent stations—than would have been the case if the train had not been delayed. As a result of this, this train will have to carry an increased number of passengers in proportion to its delay. This in its turn has the consequence that the following, on-time train will carry fewer people, since the delayed train traveling in front has already taken some of the passengers who should actually have been carried by the following train.

BRIEF SUMMARY OF THE INVENTION

The underlying object of the invention is to specify a device which enables the disadvantageous consequences of a train delay to be kept as small as possible.

This object is achieved in accordance with the invention by a stopping time calculation module with the features according to the independent claim. Advantageous embodiments of the inventive stopping time calculation module are specified in the sub claims.

Accordingly a stopping time calculation module for a vehicle is provided in accordance with the invention, with a communication device which makes it possible to communicate with one or more other vehicles for the transmission of the vehicle's own travel-related data and/or to receive travel-related data of the other vehicle or vehicles, and an evaluating device connected to the communication device which is suitable, in the case of a delay indicated by the travel-related data of a vehicle traveling in front or behind on a route equipped with stations, to calculate an extended stopping time for the current station or a following station, especially the next station, which exceeds the stopping time specified in accordance with the timetable, and to create a control signal which specifies the calculated stopping time.

A significant advantage of the inventive stopping time calculation module consists in the vehicles being able to communicate with one another via their communication devices and thus being able to calculate extended stopping times in the stations by themselves or autonomously. The use of a central control desk, which has to monitor and control a plurality of vehicles, is thus not necessary for calculating extended stopping times.

A further significant advantage of the inventive stopping time calculation module is to be seen as its ability to operate more quickly than a central control desk, since a separate evaluating device is provided for each vehicle, which only has to calculate its own stopping time or its own stopping time extension. The use of decentralized stopping time calculation allows delays to be dealt with far more quickly than a central control desk would allow; this will be illustrated using an example with actual figures: In the case of stopping time calculation by a central control desk the measurement and closed-loop control times—as the inventors have established—are usually so large that only vehicle delays in the minutes range are able to be compensated for. By contrast, the inventive provision of the vehicles' own stopping time calculation modules already allows delays in the seconds range to be compensated for, so that an escalation of individual small delays into a significant operational disruption on the route as a whole can be avoided.

The calculation of an extended delay time is preferably undertaken by the evaluating device so that the spacing between the own vehicle and the vehicle traveling in front is approximated to a spacing envisioned by the timetable or is set to said distance.

Communication from vehicle to vehicle can be undertaken on direct paths, for example by radio signals from vehicle to vehicle, or on indirect paths, for example using an external communication network (e.g. a GSM (Global System for Mobile Communications) network, a WLAN (Wireless Local Area Network)-network or a UMTS (Universal Mobile Telecommunications System) network) as an agent. As explained above, communication preferably takes place without the inclusion of a control desk (or control center) monitoring the vehicles, i.e. in other words preferably "directly".

Instead of communication via radio another method of transmission can also be provided, for example via light (e.g. in the infrared range) or by wire via cables which are implemented on the route.

The stopping time calculation module is preferably used for vehicles of local rapid-transit traffic. It is seen as especially advantageous if the vehicles are rail vehicles, which are traveling on the same rail route and if the extended stopping time calculated by the stopping time calculation module relates to the station to which the vehicle is currently traveling or a next station on the rail route.

According to an especially preferred embodiment of the evaluating device there is provision for said device to calculate the extended stopping time by adding a period of time proportional to the delay of the vehicle traveling in front or behind to the stopping time envisioned by the timetable. The proportionality factor preferably lies between 0 and 1.

It is viewed as especially advantageous for the evaluating device to be embodied so that it calculates the extended stopping time by adding a period of time to the stopping time specified by the timetable which lies between 30% and 70% of the delay of the vehicle traveling in front or behind. A proportionality factor between 30% and 70% makes possible a particularly efficient regulation of the spacings between vehicles with a view to the spacing envisioned in the timetable.

In addition it is seen as advantageous if a vehicle which recalculates its own stopping time and has determined an increased stopping time transfers this result to the vehicle travelling in front or behind. Accordingly it is seen as advantageous for the evaluating device to be embodied such that, in the event of an extended stopping time compared to the stopping time specified by the timetable, it generates a control signal which indicates the extended stopping time, and transfers this control signal to at least one of the vehicles traveling in front and behind on the shared route.

If the vehicle traveling in front has caused a delay and if the vehicle's own stopping time is therefore extended, then the vehicle traveling behind will preferably be informed by the stopping time calculation module. If on the other hand the vehicle traveling behind has caused the delay and if the vehicle's own stopping time is extended, the vehicle travelling in front will preferably be informed accordingly by the stopping time calculation module.

The stopping time calculation module can additionally also take account of the traffic on other routes, to which passengers can change or for which there is provision for said change in the timetable. In this regard it is seen as advantageous for the evaluating device to be embodied such that, in the event of a delay of a vehicle traveling on another route, to which a change option is provided for by the specified timetable, it calculates an extended stopping time for at least one station lying before the location of the change, generates a control signal which indicates the extended stopping time and transfers the control signal to at least one of the vehicles traveling in front or behind on its own route.

The stopping time calculated by the stopping time calculation module can be included directly for controlling the vehicle. For example the stopping time calculation module can have a door control unit connected to the evaluating device which is suitable for activating the doors in accordance with the control signal of the evaluating device. Preferably the door control unit will open the doors of the vehicle for the calculated extended stopping time at the respective station.

As an alternative the stopping time calculation module can have a display device which has a connection to the evaluating device, on which the evaluating device displays the extended stopping time.

In respect of the realization of the stopping time calculation module, it is seen as advantageous for the evaluating device to have a processing device and a memory in which a program is stored which, when executed by the processing device, calculates an extended stopping time if a delay of a vehicle traveling in front or behind on a shared route is indicated by travel-related data.

The invention also relates to a rail vehicle with a stopping time calculation module as described above. As regards the advantages of the inventive rail vehicle, the reader is referred to the advantages of the inventive stopping time calculation module explained above, since the advantages of the inventive stopping time calculation module correspond to those of the inventive rail vehicle.

The invention also relates to a method for controlling a vehicle. In accordance with the invention there is provision in this case for travel-related data of one or more other vehicles traveling on a shared route equipped with stops to be received, in the event of a delay of a vehicle traveling in front or behind on the route, for an extended stopping time to be calculated for a subsequent stop, especially the next stop, which exceeds the stopping time specified in accordance with the timetable and for a control signal to be created which specifies the calculated stopping time.

As regards the advantages of the inventive method, the reader is referred to the remarks given above in conjunction with the inventive stopping time calculation module, since the advantages of the inventive stopping time calculation module correspond to those of the inventive method.

The invention will be explained in greater detail below on the basis of exemplary embodiments; in the figures, by way of example

DESCRIPTION OF THE INVENTION

Figure 1:
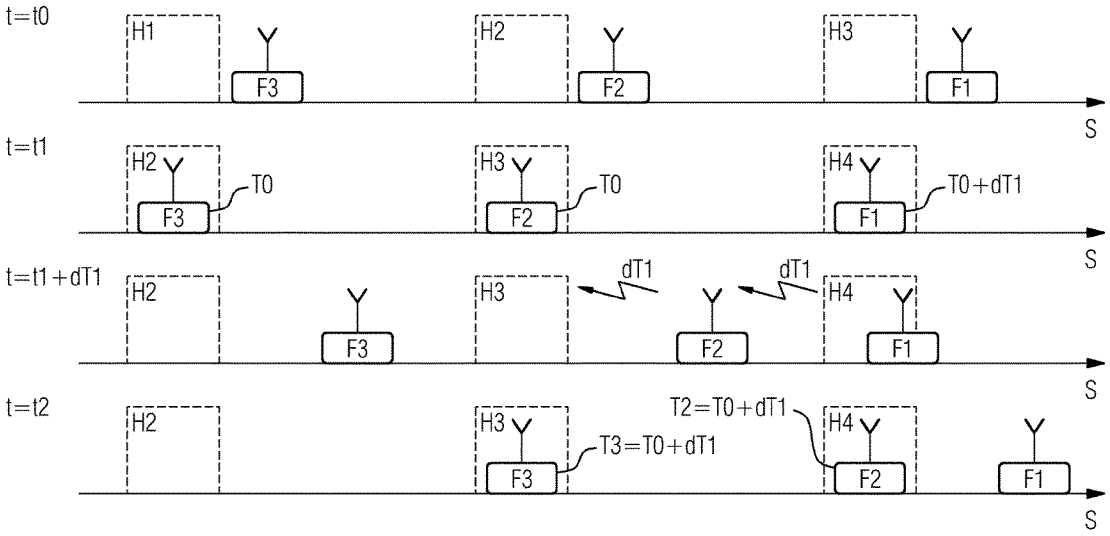
FIG. 1 shows a first exemplary embodiment for an inventive method for controlling a vehicle, wherein in this exemplary embodiment a vehicle-side delay is taken into account in vehicles traveling behind with a proportionality factor of k.

In the figures, for the sake of clarity, the same reference characters are always used for identical or comparable components.

FIG. 1 shows an exemplary embodiment for a method in which, in the event of a delay to a rail vehicle traveling in front, the rail vehicles traveling behind extend their stopping time in the next station in order to maintain or restore the spacing between the rail vehicles envisioned in accordance with the timetable.

FIG. 1 shows three rail vehicles F1, F2 and F3, which are formed for example respectively by subway or local rapid transit trains and serve a shared line (railroad line, for example subway line "U1") in each case. The rail vehicles F1, F2 and F3 thus form rail-based railroad vehicles which travel over or "serve" a shared route S. Stops in the form of stations H1, H2 and H3, through which the rail vehicles F1, F2 and F3 pass in turn, are located on the route.

At time t=t0 the three rail vehicles F1, F2 and F3 are traveling in accordance with the timetable so that the spacing between the rail vehicles is at least approximately constant.

At time t=t1 the rail vehicle F3 reaches the station H2, the rail vehicle F2 reaches the station H3 and the rail vehicle F1 reaches the station H4. In accordance with the timetable the stopping time in the stations is to be T0 in each case.

While the two vehicles F2 and F3 keep to the stopping time of T0 envisioned by the timetable, there is an extension—for whatever reasons—to the stopping time for vehicle F1 in station H4. The vehicle F1 would thus not leave the station H4 after the intended stopping time T0, but with a delay of dT1.

FIG. 1 shows that, at time t=t1+dT1, the vehicles F2 and F3 have already left their stations H2 and H3 and are at the midpoint on the route: thus the vehicle F3 is on the route section between the stations H2 and H3 and the rail vehicle F2 is on the route section between the stations H3 and H4. The vehicle F1 ahead is only just leaving the station H4 at this time t=t1+dT1.

In order to avoid the delayed departure of the vehicle F1 leading to a permanent disruption of travel operation and a permanent non-adherence to the predetermined timetable, the vehicle F1 traveling ahead will send a control signal to the vehicle F2 traveling behind, with which it transmits its own delay dT1 to the vehicle F2 traveling behind.

The vehicle F2 traveling behind will transfer the received control signal with the delay specification dT1 to the vehicle F3 traveling behind the vehicle F2, so that both vehicles F2 and F3 traveling behind are each given information about the delay of the vehicle F1 traveling in front.

The two vehicles F2 and F3 traveling behind will take account of the delay dT1 of the vehicle F1 traveling in front by extending their respective stopping times accordingly in the stations H3 and H4 ahead.

Thus if the vehicle F2 reaches the station H4 and the vehicle F3 reaches the station H3 at time t=t2, then both vehicles will remain in the stations for longer than specified by the timetable. The stopping time T2 of the vehicle F2 will for example be T2=T0+dT1 and the extended stopping time T3 of the vehicle F3 will be T3=T0+dT1.

Because of the extension of the stopping time in the stations H3 and H4, the spacing to the delayed vehicle F1 will be adapted to the spacing envisioned in the timetable or set to said spacing.

Figure 2:
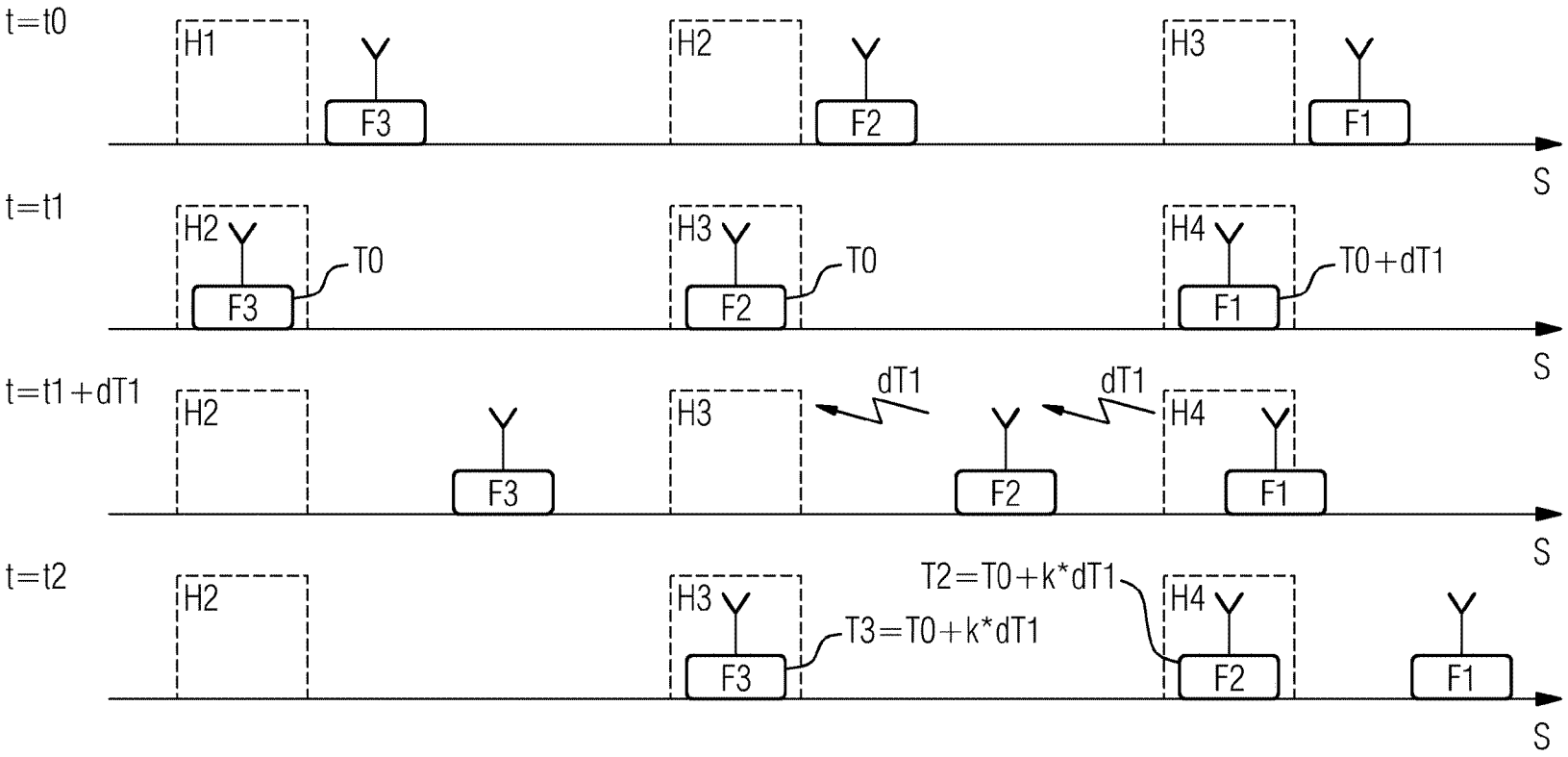
FIG. 2 shows a second exemplary embodiment for an inventive method, whereby in this exemplary embodiment a delay to a vehicle traveling ahead leads to a stopping time extension of the vehicles traveling behind with a proportionality factor k.

FIG. 2 shows an exemplary embodiment for a method in which, in the event of a delay of a vehicle traveling ahead, the vehicles traveling behind calculate an extended stopping time taking into account a proportionality factor.

Let the situation at the times t=t0, t=t1 and t=t1+dT1 be identical for example to the situation that has already been explained in FIG. 1. The vehicle F1 traveling ahead has a delay dT1 at station H4, which it transmits by means of a corresponding control signal to the vehicle F2 traveling behind, which in its turn forwards the delay dT1 to the vehicle F3.

By contrast with the exemplary embodiment according to FIG. 1, in the exemplary embodiment according to FIG. 2, the extended stopping times T2 and T3 are calculated taking into account a proportionality factor k. Thus the vehicle F2 in station H4 will calculate an extended stopping time T2 in accordance with the following equation:

$$T2=T0+k*dT1,$$

wherein k refers to the proportionality factor, dT1 to the delay of the vehicle F1 traveling ahead and T0 to the stopping time in accordance with the timetable.

In a corresponding manner the vehicle F3 traveling behind the vehicle F2 will calculate an extended stopping time T3 in station H3, in accordance with:

$$T3=T0+k*dT1.$$

Preferably the following applies for the proportionality factor k:

$$0\leq k\leq 1,$$

wherein a range between 0.1 and 0.9, especially between 0.3 and 0.7, is viewed as especially preferable.

Figure 3:
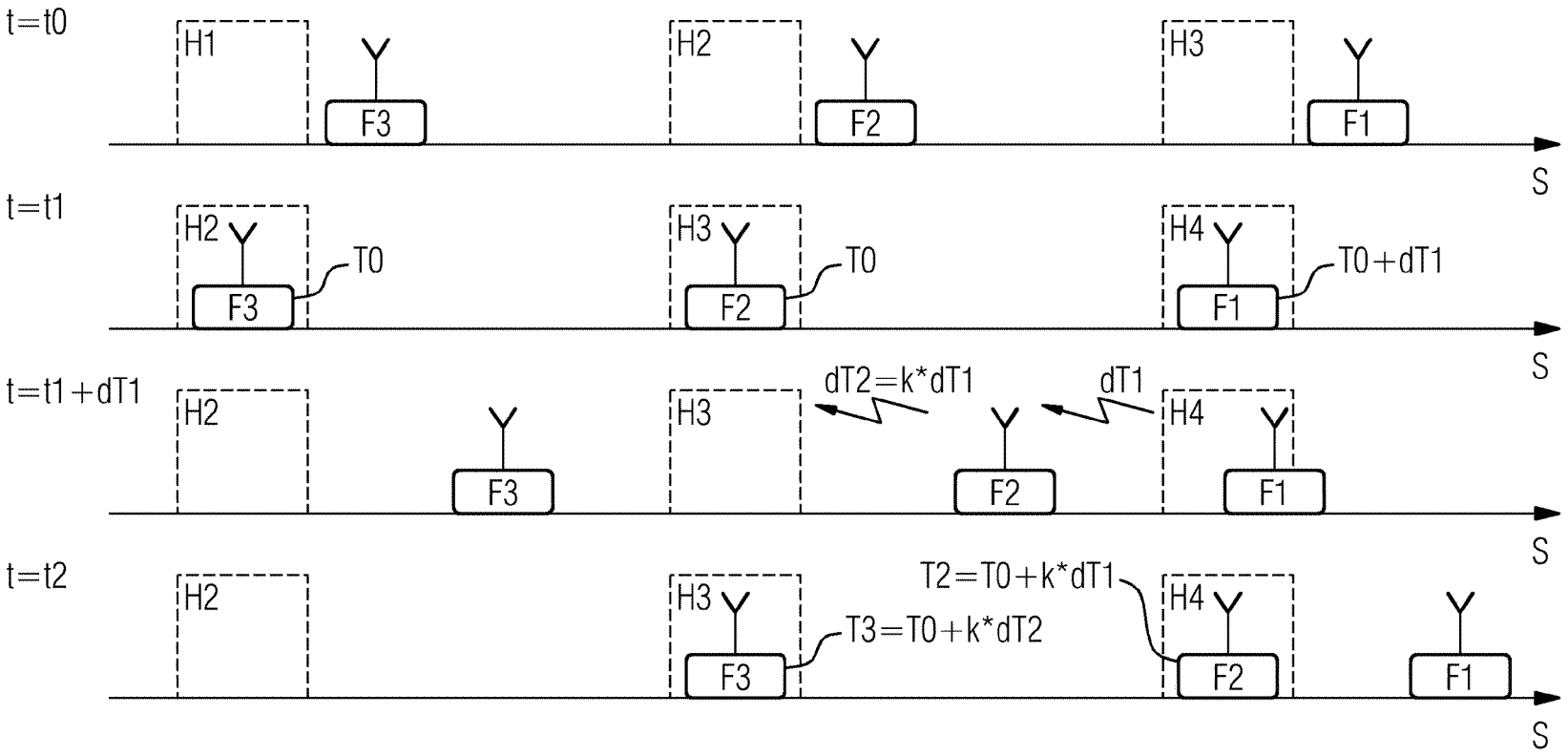
FIG. 3 shows a third exemplary embodiment for an inventive method, in which a cascaded calculation of stopping time extensions, each with a proportionality factor k, is undertaken.

FIG. 3 shows an exemplary embodiment for a method in which, in the event of a delay of a vehicle traveling in front, the vehicles traveling behind can provide extended stopping times in the next station in each case, wherein the stopping time extension differs from vehicle to vehicle.

In FIG. 3 it can be seen that the vehicle F1 traveling in front has a delay of dT1, which it transmits in the form of a control signal to the vehicle F2 traveling behind. The vehicle F2 traveling behind calculates an extended stopping time at the next station H4, taking into account the delay dT1 of the vehicle F1 traveling ahead, and does so in accordance with the following equation:

$$T2=T0+k*dT1,$$

wherein dT1 describes the delay of the vehicle F1 traveling ahead, T0 the stopping time in accordance with the timetable and k a predetermined proportionality factor. The proportionality factor preferably lies in the range between 30% and 70%.

Because of the extended stopping time of the vehicle F2 at station H4—as seen by the vehicle F3 traveling behind—this will result in a delay of vehicle F2 on the route S. The vehicle F2 transmits this delay value, in the form of a control signal, to the vehicle F3 traveling behind, with which the delay dT2 of the vehicle F2 in relation to the timetable is notified. The delay dT2 of the vehicle F2 amounts to:

$$dT2=T2-T0=k*dT1.$$

The vehicle F3, after receiving the control signal relating to the delay dT2 of vehicle F2, will calculate an extended stopping time T3 in the station H3 ahead and accordingly stop in station H3 for longer than envisioned in the timetable. The stopping time of the vehicle F3 in station H3 amounts for example to:

$$T3=T0+dT3=T0+k*dT2.$$

The vehicle F3 thus calculates the extension dT3 of the stopping time, taking into account its proportionality factor k and also the vehicle F2 ahead. In other words the stopping time extension of the vehicle F3 will amount to k times the extension dT2 of the vehicle F2. In relation to the vehicle F1 causing the delay, the following equation thus applies for the extension dT3 of the stopping time T3 of the vehicle F3:

$$T3=T0+dT3=T0+k*dT2=T0+k2*dT1 \text{ or}$$

$$dT3=k*dT2=k2*dT1$$

Figure 4:
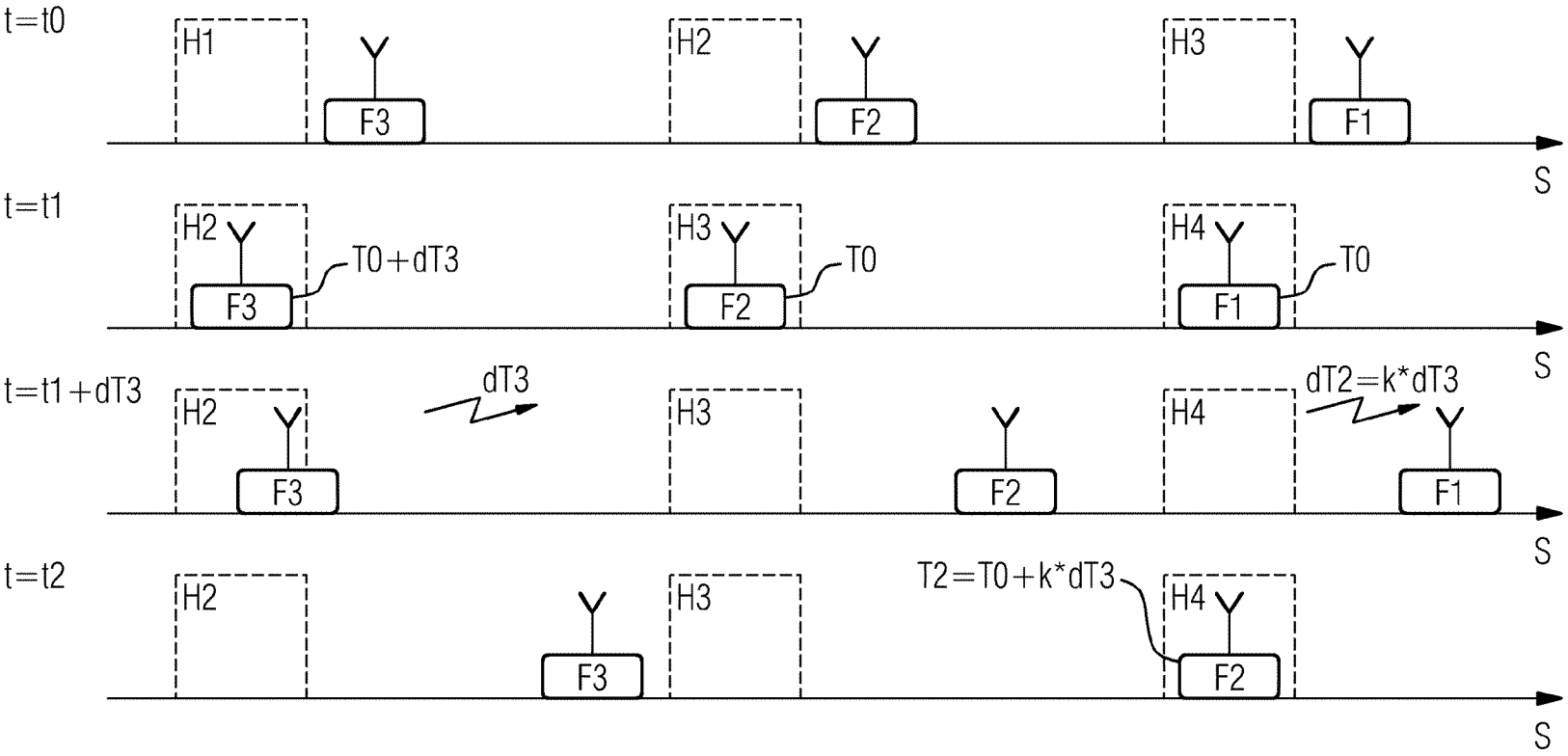
FIG. 4 shows a fourth exemplary embodiment for an inventive method, in which the delay of a vehicle traveling behind is taken into account.

FIG. 4 shows an exemplary embodiment for a method in which a rail vehicle F2 on a shared route S takes account of a delay dT3 of a rail vehicle F3 traveling behind it.

It can be seen in FIG. 4 that the vehicle F3 traveling behind, at time t=t1+dT3, has a delay of dT3, which it transmits in the form of a control signal to the vehicle F2 traveling ahead. The vehicle F2 traveling ahead, taking into account the delay dT3 of the vehicle F3 traveling behind, calculates an extended stopping time T2 in the station H4 ahead, and does so in accordance with the following equation:

$$T2=T0+k*dT3,$$

wherein dT3 describes the delay of the vehicle F3 traveling behind, T0 the stopping time in accordance with the timetable and k a predetermined proportionality factor. The proportionality factor k preferably lies in the range between 30% and 70%.

Because of the extended stopping time of the vehicle F2 in station H4, the result—as seen by the vehicle F1 traveling ahead—will be a delay of vehicle F2 on the route S. The vehicle F2 transmits this delay value to the vehicle F1 ahead in the form of a control signal, with which the delay dT2 of the vehicle F2 in relation to the timetable is communicated. The vehicle F1, after receiving the control signal relating to the delay dT2 of the vehicle F2, will calculate an extended stopping time in one or more stations ahead and accordingly will stop in the stations for longer than the time envisioned in the timetable.

Figure 5:
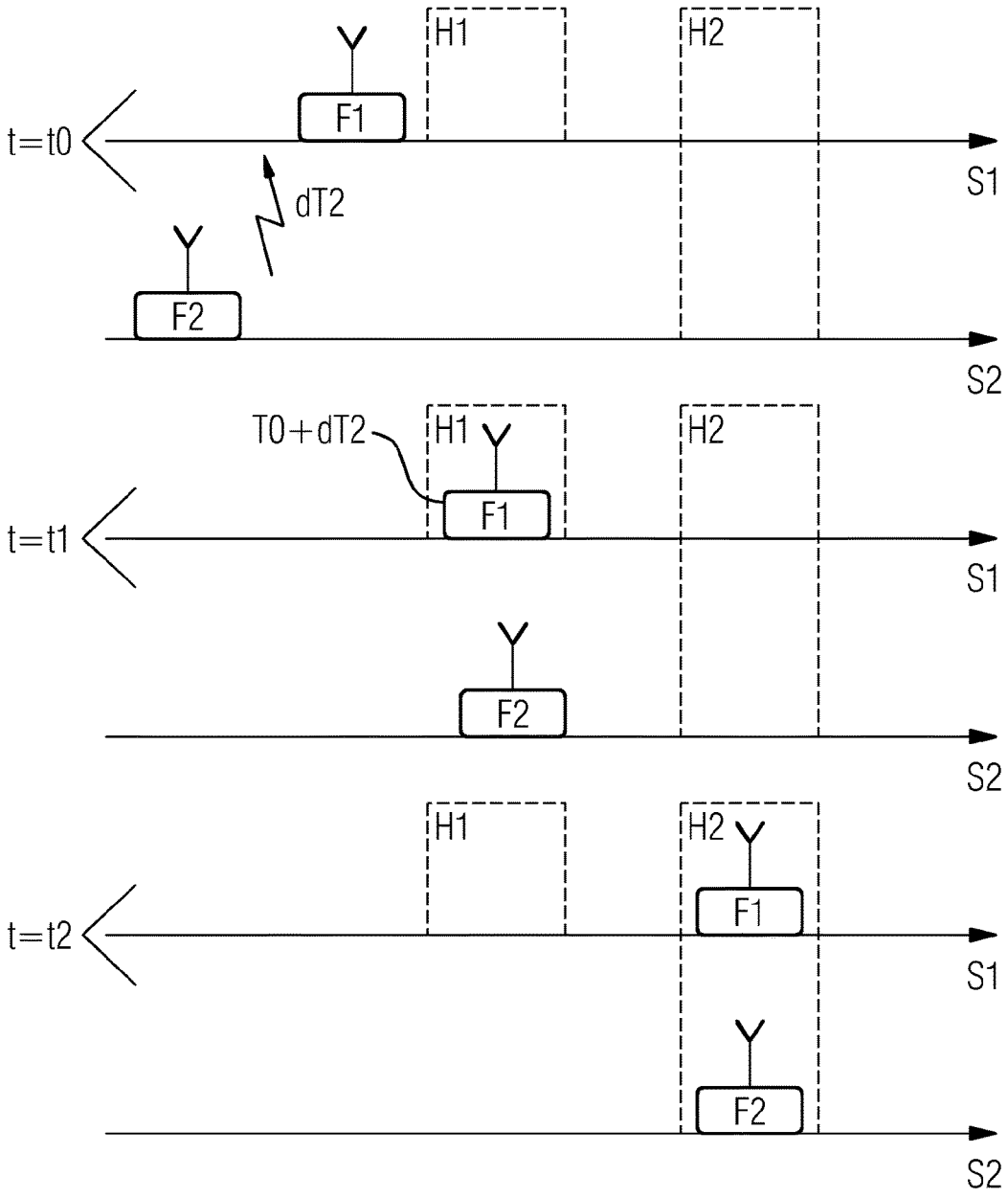
FIG. 5 shows a fifth exemplary embodiment for an inventive method, in which the delay of a vehicle traveling on another route is taken into account.

FIG. 5 shows an exemplary embodiment for a method in which a rail vehicle F1 on a route S1 takes account of a delay dT2 of a rail vehicle F2 on another route S2. It can be seen in FIG. 5 that the delay dT2 is communicated by rail vehicle F2 on the route S2 at time t=t0 to the rail vehicle F1.

The rail vehicle F1, taking account of the delay dT2, calculates an extended stopping time T2=T0+dT2 in station H1, which is located on route S1. Because of the extension of the stopping time in station H1, the delay of the vehicle F2 on the route S2 will be compensated for at least approximately and a synchronization of the travel movements of the two vehicles F1 and F2 on the two routes S1 and S2 will be re-established. If the vehicles F1 and F2 are arriving at the station H2 at t=t2, they are at least approximately synchronized, so that a possibility envisioned by the timetable of changing between vehicles F1 and F2 in station H2 can be offered.

In summary the method in accordance with FIG. 5 thus makes it possible to take account of delays of rail vehicles belonging to different lines or traveling on different routes in order to maintain the possibility of passengers changing between the rail vehicles.

Figure 6:
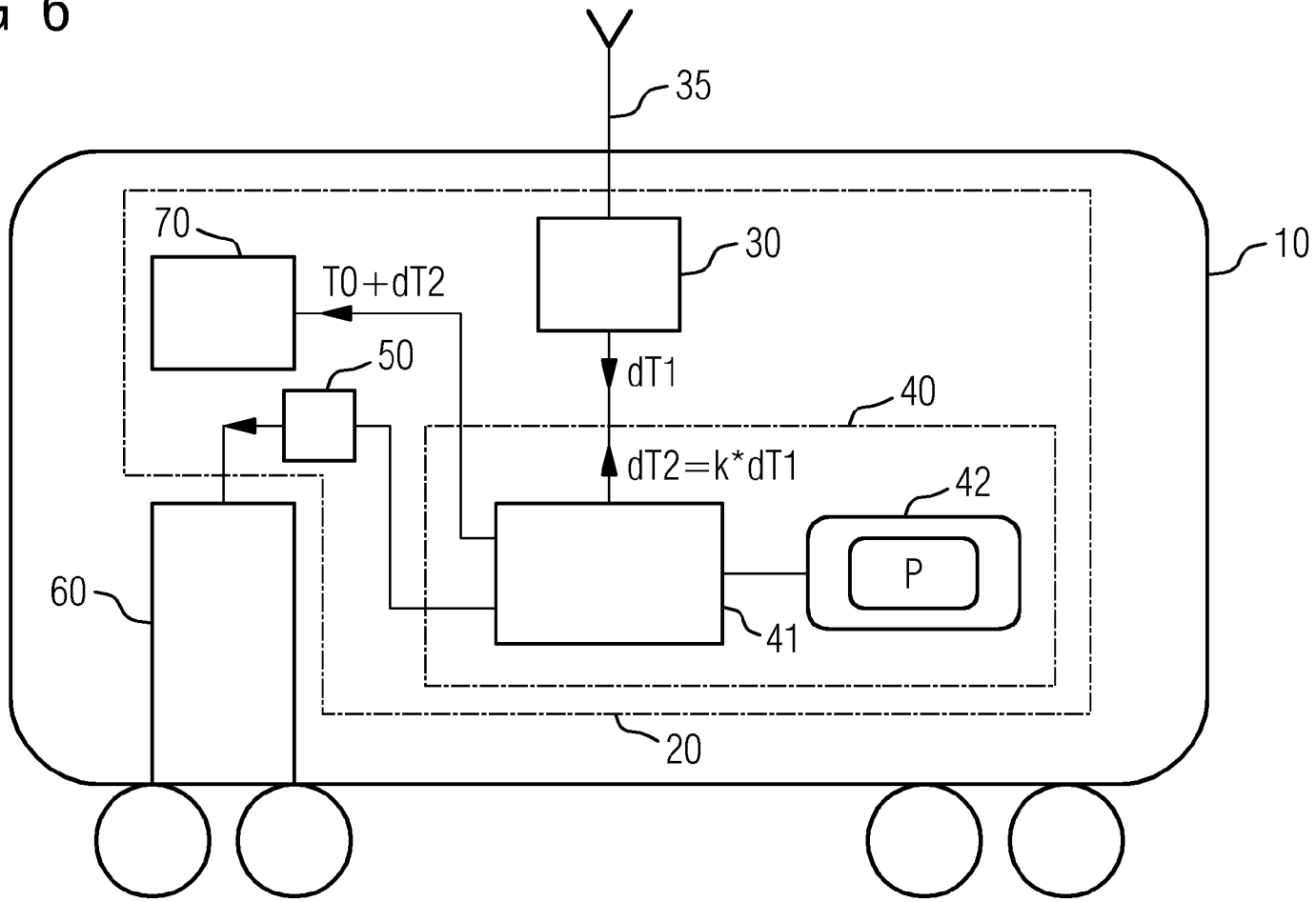
FIG. 6 shows an exemplary embodiment for a rail vehicle with an inventive stopping time calculation module.

FIG. 6 shows an exemplary embodiment for an inventive rail vehicle 10 which is equipped with an exemplary embodiment for an inventive stopping time calculation module 20.

The stopping time calculation module 20 includes a communication device 30, to which for example an antenna 35 for wireless communication with other vehicles is connected. Instead of wireless transmission, transmission over wires can also be provided, for example over signal transmission wires which are implemented in the rail network.

An evaluation device 40, which includes a processing device 41 in the form of a computer as well as a memory 42, is connected to the stopping time calculation module 20. Stored in the memory 42 is a control program P which is executed by the processor device 41. With regard to the embodiment of the computer program P and the method of operation of the processing device 41 based thereon, the reader is referred to the exemplary embodiments given above in conjunction with FIGS. 1 to 5.

The stopping time calculation module 20 additionally includes a door control unit 50, which is connected to one or more doors 60 of the rail vehicle 10 and is suitable for opening or closing the doors 60 for the respective computed (and possibly extended) stopping time T2=T0+dT2.

In addition the stopping time calculation module 20 is equipped with a display device 70 which makes it possible to display extended stopping times of the rail vehicle 10.

The rail vehicle 10 in accordance with FIG. 6 can be described for example as follows:

1. Delay of a Vehicle Traveling Ahead or a Vehicle Traveling Behind:

if the communication device 30 of the stopping time calculation module 20 receives a delay dT1 of a rail vehicle traveling ahead or traveling behind, the delay dT1 is communicated to the processing device 41. The processing device 41—controlled by the computer program P in memory 42—will calculate an extended stopping time for the respective next station or station ahead. The stopping time extension produced or the delay dT2 produced for the rail vehicle 10 can for example be calculated as follows:

$$dT2=k*dT1,$$

wherein k refers to a proportionality factor.

The evaluating device 40, by employing the communication device 30 and the antenna 35, will communicate the delay dT2 to the respective vehicle traveling ahead or traveling behind: The evaluating device 40, in the event of a delay of a vehicle traveling ahead, will communicate the extension of the waiting time in the next station here and thus its own delay to be expected, preferably to the vehicle traveling behind in each case. If on the other hand the vehicle traveling behind has found out about the delay of dT1 and if therefore the waiting time of the rail vehicle 10 is extended, then the evaluating device 40 with the assistance of the communication device 30 and the antenna 35, will communicate the delay dT2 of the rail vehicle 10 produced to the vehicle ahead.

2. Delay of a Vehicle on Another Route:

In a corresponding way the evaluating device 40, in the event of a delay of vehicle traveling on another route, to which passengers are provided with an option of changing in accordance with a predetermined timetable, can calculate an extended stopping time in one of the stops lying before the location where passengers can change trains, which exceeds the stopping time for this stop in accordance with the timetable, in order to make possible a temporal and spatial synchronization with the vehicle traveling on the other route.

Although the invention has been illustrated and described in greater detail by the preferred exemplary embodiments, the invention is not restricted by the disclosed examples and other variations can be derived therefrom by the person skilled in the art, without departing from the scope of protection of the invention.

The invention claimed is:

1. A stopping time calculation machine for a vehicle, comprising:

a communication device enabling communication with at least one other vehicle for transmission of a vehicle's own travel-related data and/or for receiving the travel-related data of the at least one other vehicle, the travel-related data including data relating to vehicle delays and stoppages; and an evaluating device connected to said communication device and having a computer, said evaluating device, in a case of a delay indicated by the travel-related data of the vehicle traveling ahead or behind on a shared route equipped with stops, calculating an extended stopping time for a current stop or for a subsequent stop, including a next stop, which exceeds a stopping time specified in accordance with a timetable, and said evaluating device creating a control signal specifying the extended stopping time, said communication device and said evaluation device disposed in or on the vehicle.

2. The stopping time calculation machine according to claim 1, wherein the vehicle and the at least one other vehicle are rail vehicles which are traveling on the shared route, and the extended stopping time calculated by the stopping time calculation module relates to a current station or to a next station.

3. The stopping time calculation machine according to claim 1, wherein the extended stopping time is dimensioned such that a spacing between the vehicle and the other vehicle traveling ahead is approximated to a spacing envisioned in the timetable or is set to the spacing.

4. The stopping time calculation machine according to claim 1, wherein said evaluating device is embodied so that said evaluating device calculates the extended stopping time in that said evaluating device adds to the stopping time specified in accordance with the timetable a period of time proportional to a delay of the other vehicle traveling ahead or behind.

5. The stopping time calculation machine according to claim 1, wherein said evaluating device calculates the extended stopping time in that said evaluating device adds to the stopping time specified in accordance with the timetable a period of time which lies between 30% and 70% of a delay of the other vehicle traveling ahead or behind.

6. The stopping time calculation machine according to claim 1, wherein said evaluating device is embodied so that, in an event of the stopping time extended in relation to the stopping time specified in the timetable, said evaluating device creates a further control signal which displays the stopping time compared to the stopping time specified in the timetable, and said evaluating device transmits the further control signal to at least one the other vehicle traveling directly ahead or behind on the shared route.

7. The stopping time calculation machine according to claim 1, wherein said evaluating device is embodied such that, in an event of a delay of the vehicle traveling on another route to which passengers are provided with an option of changing in accordance with a specified timetable, said evaluating device calculates the extended stopping time for at least one stop lying before a location where the passengers are able to change trains, wherein the extended stopping time exceeds the stopping time specified in accordance with the timetable, said evaluating device creates a further control signal which displays the extended stopping time, and said evaluating device transmits the further control signal to at least one of the other vehicles traveling ahead or behind on its own route.

8. The stopping time calculation machine according to claim 1, further comprising a door control unit connected to said evaluating unit and controlling at least one door in accordance with the control signal of said evaluating unit.

9. A rail vehicle, comprising:

a stopping time calculation machine, containing:

a communication device enabling communication with at least one other vehicle for transmission of a vehicle's own travel-related data and/or for receiving the travel-related data of the at least one other vehicle, the travel-related data including data relating to vehicle delays and stoppages; and an evaluating device connected to said communication device and having a computer, said evaluating device, in a case of a delay indicated by the travel-related data of the other vehicle traveling ahead or behind on a shared route equipped with stops, calculating an extended stopping time for a current stop or for a subsequent stop, including a next stop, which exceeds a stopping time specified in accordance with a timetable, and said evaluating device creating a control signal specifying a calculated stopping time.

10. A method for controlling a vehicle, which comprises the steps of:

receiving, via a communications device selected from the group consisting of a wireless communication device having an antenna and a wired communication device having an interface for connecting to a wire, travel-related data of at least one other vehicle traveling on a shared route equipped with stops, the travel-related data including data relating to vehicle delays and stoppages;

calculating, via a computer, an extended stopping time for a subsequent stop, especially the next stop, which exceeds a stopping time predetermined in accordance with a timetable in an event of a delay of the other vehicle traveling ahead or behind on the shared route; and creating a control signal specifying a calculated stopping time.

11. The method according to claim 10, wherein the subsequent stop is a next stop.

* * * * *